US006875309B2

(12) United States Patent
Bubik et al.

(10) Patent No.: US 6,875,309 B2
(45) Date of Patent: Apr. 5, 2005

(54) TWIN WIRE FORMER

(75) Inventors: Alfred Bubik, Ravensburg (DE); Joachim Hennssler, Ravensburg (DE); Jürgen Prössl, Horgenzell (DE); Franz Stelzhammer, Böheimkirchen (AT)

(73) Assignee: Voith Paper Patent GmbH, Heidenheim (DE)

( * ) Notice: Subject to any disclaimer, the term of this patent is extended or adjusted under 35 U.S.C. 154(b) by 37 days.

(21) Appl. No.: 10/019,285

(22) PCT Filed: Apr. 27, 2001

(86) PCT No.: PCT/EP01/04774

§ 371 (c)(1),
(2), (4) Date: Jan. 2, 2002

(87) PCT Pub. No.: WO01/83882

PCT Pub. Date: Nov. 8, 2001

(65) Prior Publication Data

US 2004/0069430 A1 Apr. 15, 2004

(30) Foreign Application Priority Data

May 2, 2000 (DE) ..... 100 21 320

(51) Int. Cl.[7] ..... D21F 9/00; D21F 11/00

(52) U.S. Cl. ..... 162/203; 162/205; 162/300; 162/301; 162/305; 162/306

(58) Field of Search ..... 162/123, 132, 162/133, 193, 199, 203, 272, 273, 298–301, 303–306, 358.1, 358.3, 360.2, 360.3, 204–207

(56) References Cited

U.S. PATENT DOCUMENTS

| | | | | | |
|---|---|---|---|---|---|
| 3,726,758 | A | | 4/1973 | Parker et al. | |
| 3,844,881 | A | * | 10/1974 | Moody | 162/297 |
| 3,951,736 | A | * | 4/1976 | Kobayashi | 162/274 |
| 4,209,360 | A | * | 6/1980 | Stenberg et al. | 162/203 |
| 4,406,739 | A | * | 9/1983 | Kankaanpaa | 162/203 |
| 4,417,950 | A | * | 11/1983 | Bubik et al. | 162/300 |
| 4,425,187 | A | * | 1/1984 | Armstrong et al. | 162/299 |
| 4,925,531 | A | | 5/1990 | Koski | |
| 6,254,728 | B1 | | 7/2001 | Henssler et al. | |
| 6,267,846 | B1 | * | 7/2001 | Halmschlager et al. | 162/203 |

FOREIGN PATENT DOCUMENTS

| | | | | |
|---|---|---|---|---|
| DE | 3117463 | | 4/1982 | |
| DE | 3222428 | | 12/1983 | |
| DE | 19654325 | | 6/1998 | |
| DE | 19702575 | | 7/1998 | |
| DE | 19733316 | | 2/1999 | |
| DE | 19744341 | | 4/1999 | |
| DE | 19803591 | | 8/1999 | |
| DE | 19950805 | | 4/2001 | |
| EP | 933473 | | 8/1999 | |
| EP | 0 933 473 | * | 8/1999 | D21G/9/00 |
| FR | 2093632 | | 1/1972 | |

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

The invention relates to a twin wire former (1) for producing a fibrous web (4), in particular a paper, cardboard or tissue web, from a fibrous suspension according to the generic terms of claim 1. The twin wire former (1) is characterized in that, the two wire belts (2, 3) run upwards after a passing a first deviation device (10), forming an angle (β) relative to an imaginary second horizontal plane (H2), in such a way that the upper vertex (15.SO) of the second deviation device (15) lies above the lower vertex (10.SU) of the first deviation device (10), and that the angle (δ) relative to the imaginary first plane (H1) runs downwards.

13 Claims, 6 Drawing Sheets

TWIN WIRE FORMER

CROSS-REFERENCE TO RELATED APPLICATIONS

The present application is a U.S. National Stage of International Application No. PCT/EP01/04774 filed April 27, 2001, which published on Nov. 8, 2001, as WO 01/83882, and which claims priority under 35 U.S.C. § 119 of German Patent Application No. 100 21 320.0 filed May 2, 2000.

BACKGROUND OF THE INVENTION

1. Field of the Invention

The invention relates to a twin-wire former for producing a fibrous web, in particular a paper, board or tissue web, from a fibrous suspension. The twin-wire former includes two endless wire belts arranged to form a twin-wire zone, in which, in a first section of the twin-wire zone, the two wire belts run over a dewatering element in the form of a rotating forming roll and together form a wedge-like inlet gap which picks up the fibrous stock suspension directly from a headbox fitted at an angle relative to an imaginary first horizontal plane, and in which, in a second section of the twin-wire zone, the two wire belts with the fibrous web forming between them run downward over further dewatering elements at an angle ($\alpha$) of 10° to 60° relative to an imaginary first vertical plane. At the end of the second section of the twin-wire zone, the two wire belts run over a first deflection device with a lower vertex and then over at least one separating device which acts over the machine width and, in the area in which one of the wire belts is led away from the forming fibrous web and the other wire belt. A second deflection device with an upper vertex is arranged after the separating device to deflect the wire belt that carries the forming fibrous web.

2. Discussion of Background Information

A twin-wire former of this type is known from the German Published Specification DE 198 03 591 A1 (PB 10656 DE) from the Applicant. The twin-wire former has two wire belts (lower wire and upper wire), which together form a twin-wire zone. In a first part of the twin-wire zone, in which the two wire belts run over a dewatering element in the form of a rotating forming roll, the two wire belts together form, directly at the forming roll, a wedge-like inlet gap, which picks up the fibrous stock suspension directly from a headbox ("gap former"). In a second section of the twin-wire zone, the two wire belts with the fibrous web forming between them run steeply downward over further dewatering elements, for example over a plurality of forming foils and/or at least one forming shoe, preferably at an angle of 10° to 60° relative to an imaginary vertical plane. At the end of the second section of the twin-wire zone, the wire belts run over a deflection device and then over a separating device, which separates one of the wire belts from the forming fibrous web and from the other wire belt.

The disadvantage with this known twin-wire former is that, because of the relatively great forming roll diameter, which can assume a value for example between 1.5 and 2.5 m, it has a very large overall height. This large overall height leads to problems with regard to the height of the hall or crane, particularly in the case of rebuilds, and therefore to increased rebuilding costs and overhaul or operating costs.

SUMMARY OF THE INVENTION

Therefore, the instant invention provides a twin-wire former of the type mentioned at the beginning in such a way that the overall height is reduced such that, during rebuilds, no significant additional costs (rebuilding costs, overhaul costs, operating costs) arise and that, at relatively high machine speeds, complete secondary dewatering is made possible.

In the case of a first twin-wire former of the type mentioned at the beginning, after the first deflection device, the two wire belts run upward at an angle relative to an imaginary second horizontal plane, in that the upper vertex of the second deflection device is located above the lower vertex of the first deflection device, and in that the angle between the headbox and the imaginary first horizontal plane runs downward.

This achieves the advantage that the run of the two wire belts not only extends in a direction with regard to the overall height but, to some extent, is also of contrary design, and therefore the absolute overall height, in particular in the case of a rebuild, is reduced considerably. Furthermore, by arranging the headbox at an angle that runs downward relative to the imaginary second horizontal plane, no increase in height is achieved, that is to say the headbox does not increase the overall height of the twin-wire former, since as far as its components are concerned it is not oriented upward. In addition, on account of the deflection, the forming fibrous web is guided on an S-shaped path at an angle relative to an imaginary horizontal plane.

In further refinement of the first twin-wire former according to the invention, it is proposed that the upper vertex of the second deflection device be located at least 50 mm, preferably at least 100 mm, in particular at least 200 mm, above the lower vertex of the first deflection device, and that the angle between the headbox and the second imaginary horizontal plane assume a value between 0° and 45°, preferably between 0° and 30°.

In the case of a second twin-wire former of the type mentioned at the beginning, after the first deflection device, the two wire belts run upward at an angle relative to an imaginary second horizontal plane, in that a felt removes the forming fibrous web from the wire belt at a pickup point which is located above the lower vertex of the first deflection device, and in that the pickup point is followed by a press unit, in which the forming fibrous web is guided first through a first, preferably double-felted press nip with a first press roll and a second press roll, after the first press nip is guided, with one of the felts, around the first press roll, is then transferred to a non-felted press roll in a second press nip and then runs through at least one further single-side-felted press nip.

In the case of this second twin-wire former according to the invention, as well, the result is the advantages mentioned in the case of the first embodiment. In addition, the position of the pickup point ensures that the latter does not contribute to an increase in the overall height, in particular in the case of a rebuild, but is located in the vertical area of the upstream twin-wire former that determines the overall height.

In further refinement of the second twin-wire former according to the invention, it is proposed that the pickup point be located at least 50 mm, preferably at least 100 mm, in particular at least 200 mm, above the lower vertex of the first deflection device.

According to the invention, the angle at which, after the deflection device, the two wire belts run upward relative to an imaginary second horizontal plane assumes a value between 10 and 90°, preferably between 25° and 40°, the desired achievement of the reduction in overall height being assisted positively.

In a further advantageous refinement of the invention, it is proposed that isobaric dewatering elements, as they are known, be arranged between the first deflection device and a separating device, between which the forming fibrous web runs, enclosed between the two wire belts. Therefore, for the forming fibrous web, the achievement of the best possible formation, that is to say the most uniform possible fiber distribution is ensured, and this with the greatest possible dewatering performance and with the lowest possible energy consumption during the web formation operation. Advantageously, at least one stationary isobaric dewatering element is arranged on the one wire belt and at least one isobaric dewatering element is arranged on the other wire belt, and can be set resiliently against the wire belt by way of a selectable force. The isobaric dewatering elements can therefore be adapted in a straightforward, time-saving and cost-effective way to various operating conditions and to various fibrous suspensions.

Furthermore, the isobaric dewatering elements are designed as plates or plate segments, since these shapes can be produced and operated cost-effectively.

In a further embodiment of the invention, provision is made for at least one flat suction element to be arranged after the separating device, acting on the wire belt which carries the forming fibrous web. In this way, the dewatering and formation of the forming fibrous web is additionally positively assisted.

In an advantageous embodiment of the invention, provision is made for a deflection of the wire belt to follow the second deflection device, in such a way that the wire belt subsequently runs downward at an angle of less than 60°, preferably less than 40°, in particular less than 25°, relative to an imaginary second vertical plane.

In an alternative advantageous refinement, the deflection of the wire belt is carried out in such a way that the wire belt subsequently runs substantially horizontally, in a further refinement, a further sheet forming device, preferably a hybrid former, being arranged after the second deflection device. The wire belt advantageously runs at least 50 mm, preferably at least 100 mm, above the lower vertex of the first deflection device.

The second deflection device is preferably a suction roll, a shoe with foils or a shoe with foils and with applied vacuum, since these aforementioned elements belong to the prior art, and therefore possess increased functional reliability and low procurement costs, and possibly also low operating costs.

In a further embodiment of the invention, provision is made for the distance between the lower vertex of the first deflection device and the upper vertex of the second deflection device to have a value between 1 and 8 m, preferably between 3 and 6 m.

In this further embodiment, it is again advantageous that the overall height is reduced in such a way that, in the case of rebuilds, no substantial additional costs (rebuilding costs, overhaul costs, operating costs) arise.

With regard to constructional and economic aspects, it is advantageous if the first deflection device is a closed roll, an open roll or an open roll with applied vacuum.

Furthermore, with regard to constructional and economic aspects, it is advantageous if the separating device is designed as a suction separator and/or a vacuum shoe.

In addition, it is advantageous with regard to constructional and economic aspects if the forming roll which, according to the invention, advantageously has a diameter of greater than 1200 mm, preferably greater than 1635 mm, in particular greater than 1760 mm, is designed as an open roll, and the open forming roll is closed by way of a grille or honeycomb structure or is a suction roll.

These elements just mentioned belong to the known prior art, and therefore possess an increased functional reliability and low procurement costs, possibly also low operating costs.

With regard to a low overall height of the twin-wire former, on the one hand, and a minimum number of components in the twin-wire former, on the other hand, it is beneficial if the forming roll has a dewatering capacity which has a value of at least 50%, preferably of at least 65%, of the total dewatering capacity of the twin-wire former. The components for the remaining dewatering, together with the associated overall height, can therefore turn out to be considerably lower than is usual.

It is technologically advantageous if the dewatering on the deflection roll is greater than on the other rolls, that is to say the roll diameter of the deflection roll is greater than the roll diameter of the forming roll and/or the roll diameter of the suction roll.

Both from constructional and from financial aspects, it is advantageous if the twin-wire former has an overall height in a range from 2 to 8 m, preferably from 3 to 6 m.

The twin-wire former according to the invention is also very well suited to the application in a former rebuild, since in this case constructional conditions which are generally present, for example the dimensions of the whole, have to be taken into account and, as a result, the former rebuild should not entail any further space requirement, for example as a result of an increased overall height of the twin-wire former to be installed.

The present invention directed to a twin-wire former for producing a fibrous web from a fibrous stock suspension that includes two endless wire belts arranged to form a twin-wire zone having at least a first and second section. A first dewatering element is located in the first section, in which the two endless wire belts are arranged to run over at least a portion of the first dewatering element, and the two endless wire belts are further arranged to form a wedge-like inlet gap. A headbox is arranged obliquely to a horizontal reference to supply a fibrous stock suspension to the inlet gap. A second dewatering element is located in the second section, in which the two endless wire belts, and the forming fibrous web located between the two endless wire belts, are arranged to run obliquely downward, relative to a vertical reference, over the second dewatering element. A first deflection device is located at an end of the second section, in which the two endless wire belts are arranged to run over a lower vertex of the first deflection device, and at least one separating device is structured and arranged to act over an entire machine width and located in a region at which a first of two endless wire belts is led away from a second endless wire belt carrying the forming fibrous web. A second deflection device, located after the separating device, relative to a belt travel direction, is arranged to deflect the second endless wire carrying the forming fibrous web over an upper vertex of the second deflection device. After the first deflection device, the two endless wire belts are arranged to run upward at an angle to the horizontal reference such that the upper vertex is located above the lower vertex, and, after the second deflection device, the second endless wire carrying the forming web is arranged to run downward at an angle to the horizontal reference.

According to a feature of the instant invention, the upper vertex is located at least 50 mm above the lower vertex, preferably at least 100 mm above the lower vertex, and most preferably at least 200 mm above the lower vertex.

In accordance with another feature of the invention, the angle of the downward run after the second deflection device is between 0° and 45°, and preferably between 0° and 30°.

According to still another feature of the present invention, the fibrous web includes at one of a paper, board, or tissue web.

Moreover, the first dewatering device includes a rotating forming roll, which has a diameter greater than 1200 mm, preferably greater than 1635 mm, and most preferably greater than 1760 mm. Further, the forming roll has a dewatering capacity of at least 50% of a total dewatering capacity of the twin-wire former, and preferably the dewatering capacity of the forming roll is at least 65% of the total dewatering capacity of the twin-wire former. The forming roll includes an open roll, and the open forming roll is closed by one of a grill and honeycomb structure. Further, the open forming roll includes a suction roll.

According to the invention, the second dewatering device includes a plurality of dewatering elements.

In accordance with a further feature of the invention, the oblique downward run of the two endless wire belts is between 10° and 60°.

The twin-wire former in accordance with the instant invention further includes isobaric dewatering elements positioned between the first deflection device and the separating device. The isobaric dewatering elements are arranged such that the two endless wire belts and the forming fibrous material between the two endless wire belts are guided between the isobaric dewatering elements. Further, at least one stationary isobaric dewatering element is arranged on either the first or second endless wire and at least one other isobaric dewatering element is arranged on the other of the first or second endless wire. The at least one other isobaric dewatering element can be set resiliently against the other of the first or second endless wire with a selectable force. Still further, the isobaric dewatering elements include at least one of plates and plate segments.

According to a feature of the invention, the twin-wire former further includes at least one flat suction element, positioned after the separating device, that is structured and arranged to act on the second endless wire carrying the forming fibrous web.

In accordance with a further feature of the present invention, the angle of the downward run of the second endless wire carrying the forming web is less than 60°, preferably less than 40°, and most preferably less than 25°.

According to another feature of the invention, the second endless wire carrying the forming web is arranged so that, after the second deflection device, the second endless wire is substantially horizontally guided. Further, the second endless wire runs over the lower vertex, the second endless wire runs at least 50 mm above the lower vertex, and preferably at least 100 mm above the lower vertex.

The twin-wire former further includes a sheet forming device is arranged after the second deflection device relative to the belt travel direction. The sheet forming device includes a hybrid former.

The second deflection device includes one of a suction roll, a shoe with foils, and a shoe with foils with an applied vacuum.

A distance between the lower vertex and the upper vertex is between 1 and 8 m, and preferably between 3 and 6 m.

In accordance with a still further feature of the instant invention, the first deflection device includes one of a closed roll, an open roll, and an open roll with an applied vacuum.

Further, the separating device includes at least one of a suction separator and a vacuum shoe.

The first deflection device includes a first deflection roll and the second deflection device comprises a second deflection roll, and the first deflection roll has a roll diameter is greater than a diameter of at least one of the forming roll and the second deflection roll. Further, the second deflection roll includes a suction roll.

According to the invention, an overall height of the twin-wire former is between 2 and 8 m, and preferably between 3 and 6 m.

The present invention is directed to a twin-wire former for producing a fibrous web from a fibrous stock suspension that includes two endless wire belts arranged to form a twin-wire zone having at least a first and second section. A first dewatering element is located in the first section, in which the two endless wire belts are arranged to run over at least a portion of the first dewatering element, and the two endless wire belts are further arranged to form a wedge-like inlet gap. A headbox is arranged obliquely to a horizontal reference to supply a fibrous stock suspension to the inlet gap. A second dewatering element is located in the second section, in which the two endless wire belts, and the forming fibrous web located between the two endless wire belts, are arranged to run obliquely downward, relative to a vertical reference, over the second dewatering element. A first deflection device is located at an end of the second section, in which the two endless wire belts are arranged to run over a lower vertex of the first deflection device, and at least one separating device is structured and arranged to act over an entire machine width and located in a region at which a first of two endless wire belts is led away from a second endless wire belt carrying the forming fibrous web. A second deflection device, located after the separating device, relative to a belt travel direction, is arranged to deflect the second endless wire carrying the forming fibrous web over an upper vertex of the second deflection device, such that, after the first deflection device, the two endless wire belts are arranged to run upward at an angle to the horizontal reference. A felt is arranged to remove the forming fibrous web from the second endless wire belt at a pickup point located above the lower vertex, and a press unit, arranged to follow the pickup point, relative to a belt travel direction, includes a first and second press roll arranged to form a first press nip and third press roll arranged to form a second press nip, and a fourth press roll arranged to form a single side felted third press nip.

In accordance with a feature of the invention, the first press nip includes a double-felted press nip, and the third press roll includes a non-felted press roll. One of the felts of the double-felted press nip guide the forming fibrous web through the second press nip. Further, the non-felted press roll transfers the forming fibrous web to the third press nip.

According to another feature of the invention, the pickup point is located at least 50 mm above the lower vertex, preferably at least 100 mm above the lower vertex, and most preferably at least 200 mm above the lower vertex.

According to the invention, the angle of the upward run of the two endless wire belts after the first deflection device is between 10° and 90°, and preferably between 25° and 40°.

The present invention is directed to a process of dewatering a web in an apparatus that includes two endless wire belts arranged to form a twin-wire zone having at least a first and second section, a first dewatering element located in the first section and the two endless wire belts being arranged to form a wedge-like inlet gap, a headbox arranged obliquely to a horizontal reference in a vicinity of the inlet gap, a second dewatering element located in the second section, a first deflection device, located at an end of the second section, having a lower vertex, at least one separating device structured and arranged to act over an entire machine width, and a second deflection device located after the separating device, relative to a belt travel direction. The process includes supplying a fibrous stock suspension into the inlet gap, such that a forming fibrous web is located between the two endless wire belts, and guiding the forming fibrous web and the two endless wires over at least a portion of the first dewatering element. The process also includes guiding the forming fibrous web and the two endless wire belts obliquely downward, relative to a vertical reference, over the second dewatering element, and guiding the forming fibrous web and the two endless wire belts over the lower vertex of the first deflection device. After the first deflection device, the process includes guiding the two endless wire belts to run upward at an angle to the horizontal reference, such that the lower vertex of the first deflection device is located below the upper vertex of the second deflection device, separating a first of the two endless wire belts from a second endless wire belt carrying the forming fibrous web in a region of the separating device, and guiding the second endless wire belt carrying the forming fibrous web over the second deflection device. After the second deflection device, the process includes guiding the second endless wire carrying the forming web to run downward at an angle to the horizontal reference.

In accordance with yet another feature of the present invention, the apparatus further includes a felt and a press unit, and the process further includes removing the forming fibrous web from the second endless wire belt with the felt at a pickup point located above the lower vertex, and pressing the forming fibrous web in the press unit, arranged to follow the pickup point, relative to a belt travel direction, which includes a first and second press roll arranged to form a first press nip and third press roll arranged to form a second press nip, and a fourth press roll arranged to form a single side felted third press nip.

It goes without saying that the features of the invention mentioned above and still to be explained below can be used not only in the respectively specified combination but also in other combinations or on their own, without leaving the scope of the invention.

BRIEF DESCRIPTION OF THE DRAWINGS

Further features and advantages of the invention emerge from following description of preferred exemplary embodiments, making reference to the drawings, wherein.

DETAILED DESCRIPTION OF THE PRESENT INVENTION

Figure 1:
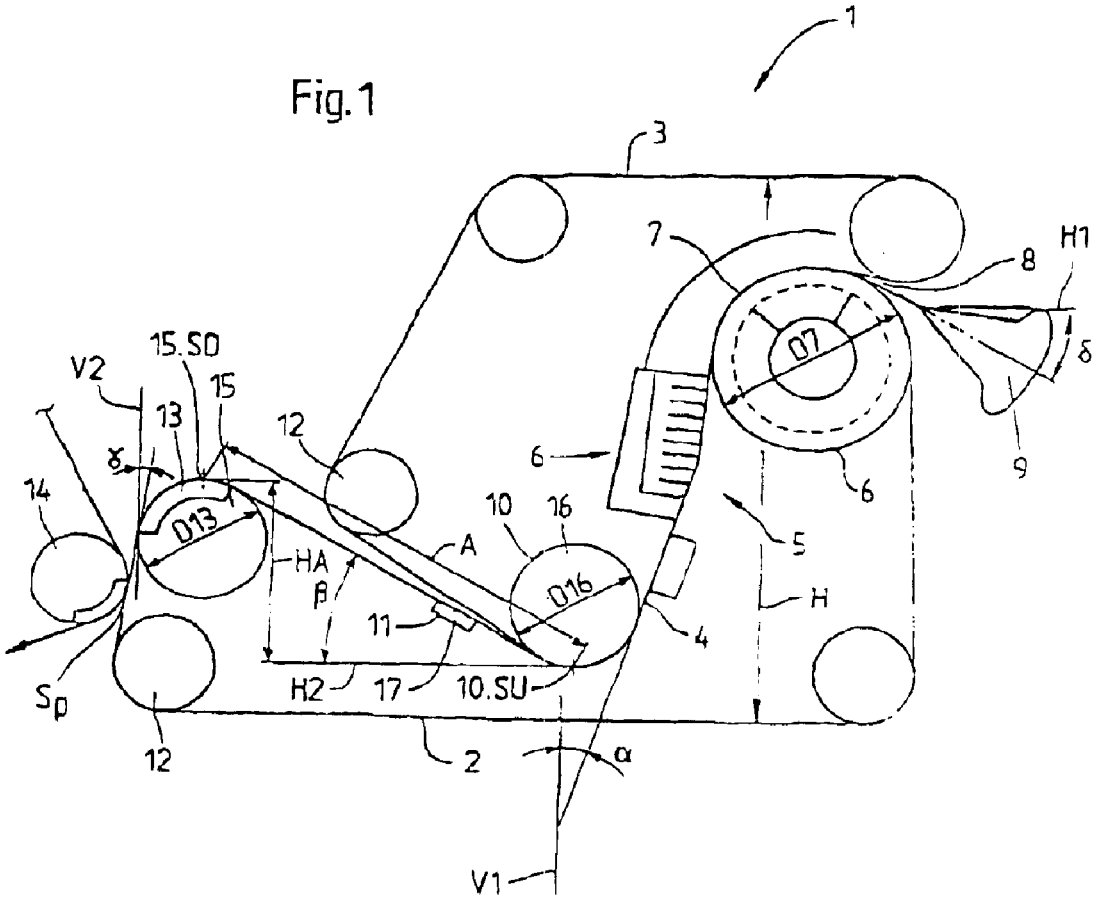
FIG. 1 shows a schematic and section side view of a first advantageous embodiment of the twin-wire former according to the invention.

The twin-wire former 1 illustrated in schematic and section side view in FIG. 1 comprises two endless wire belts, namely a lower wire 2 and an upper wire 3, which carry a forming fibrous web 4 centrally. These two wire belts 2, 3 together form a twin-wire zone 5, running over a dewatering element 6 in the form of a rotating forming roll 7 in a first section in the twin wire zone 5 and together forming a wedge-like inlet gap 8 which picks up the fibrous suspension directly from a headbox 9 fitted at an angle 8 relative to an imaginary first horizontal plane H1 ("gap former"). The headbox 9, illustrated schematically, can of course also be equipped as a multi-layer headbox and/or as a headbox with controllable-section dilution water technology ("Module Jet" system). In a second section of the twin-wire zone 5, the two wire belts 2, 3 with the fibrous web 4 forming between them run downward over a plurality of dewatering elements 6 (not specifically illustrated), such as a forming shoe, a plurality of forming foils or a plurality of isobaric dewatering elements, at an angle $\alpha$ of 10° to 60° relative to an imaginary first vertical plane V1. At the end of the second section of the twin-wire zone 5, the two wire belts 2, 3 run over a first deflection device 10 with a lower vertex 10.SU and then over a separating device 11 which acts over the machine width and in the area of which the upper wire 3 is led away from the forming fibrous web 4 and the lower wire 2. Of course, in the case of a different design of the twin-wire former 1, it is also possible for the lower wire 2 to be separated from the forming fibrous web 4 and the upper wire 3. The separated upper wire runs on to a guideroll 12 and from there, directly or indirectly, over further rolls back to the wedge-like inlet gap 8. After the separating device 11, a second deflection device 15 with an upper vertex 15.S0 is arranged, and deflects the lower wire 2 which carries the forming fibrous web 4. After that, the lower wire 2 together with the forming fibrous web 4 runs over a suction roll 13 to a pickup point $S_p$ pickup roll 14, on which the pickup roll 14 removes the fibrous web 4 from the lower wire 2 and the fibrous web 4 is transported to further manufacturing stages in the paper, board or tissue machine. The lower wire runs on to a guide roll 12 and from there, indirectly over further rolls, back to the wedge-like inlet gap 8.

According to the invention, in the first advantageous embodiment of the twin-wire former 1 according to the invention, provision is then made that, after the first deflection device 10, the two wire belts 2, 3 run upward at an angle $\beta$ relative to an imaginary second horizontal plane H2 in such a way that the upper vertex 15.S0 of the second deflection device 15 is located above the lower vertex 10.SU of the first deflection device, and that the angle $\delta$ runs downward relative to the imaginary first horizontal plane H1. In this case, the angle $\delta$ runs downward in the clockwise direction in FIG. 1 in relation to the imaginary first horizontal plane H1.

Furthermore, the upper vertex 15.S0 of the second deflection device 15 is located at least 50 mm, preferably at least 100 mm, in particular at least 200 mm, above the lower vertex 10.SU of the first deflection device 10 and, according to the invention, the angle $\delta$ assumes a value between 0° and 45°, preferably between 0° and 30°.

In addition, the angle $\beta$, at which the two wire belts 2, 3 run upward relative to an imaginary second horizontal plane H2 after the first deflection device 10, assumes a value between 10° and 90°, preferably between 25° and 40°.

In addition, the invention provides for a deflection of the wire belt 2 to be carried out at the second deflection device 15 in such a way that the wire belt 2 then runs downward at an angle $\gamma$ of less than 60°, preferably less than 40°, in particular less than 25°, relative to an imaginary second vertical plane V2.

The forming roll 7 in FIG. 1 has a diameter D7 of greater than 1200 mm, preferably greater than 1635 mm, in particular greater than 1760 mm, and is designed as a suction roll; however, it can also be designed as an open roll, it being possible for the open roll in turn to be closed by way of a grille or honeycomb structure.

Furthermore, the forming roll 7 has a dewatering capacity which has a value of at least 50%, preferably of at least 65%, of the total dewatering capacity of the twin-wire former.

The first deflection device 10 is a closed roll 16; however, it can also be an open roll or an open roll with applied vacuum. Furthermore, in FIG. 1 the separating device 11 is designed as a suction separator 17; however, it can also be designed as a vacuum shoe.

The second deflection device 15 is designed as a suction roll; however, it can also be designed as a shoe with foils or a shoe with foils and with applied vacuum.

The distance A between the lower vertex 10.SU of the first deflection device 10 and the upper vertex 15.S0 of the second deflection device 15 assumes a value between 1 and 8 m, preferably between 3 and 6 m. The twin-wire former 1 preferably assumes an overall height H in a range from 2 to 8 m, preferably from 3 to 6 m.

Figure 2:
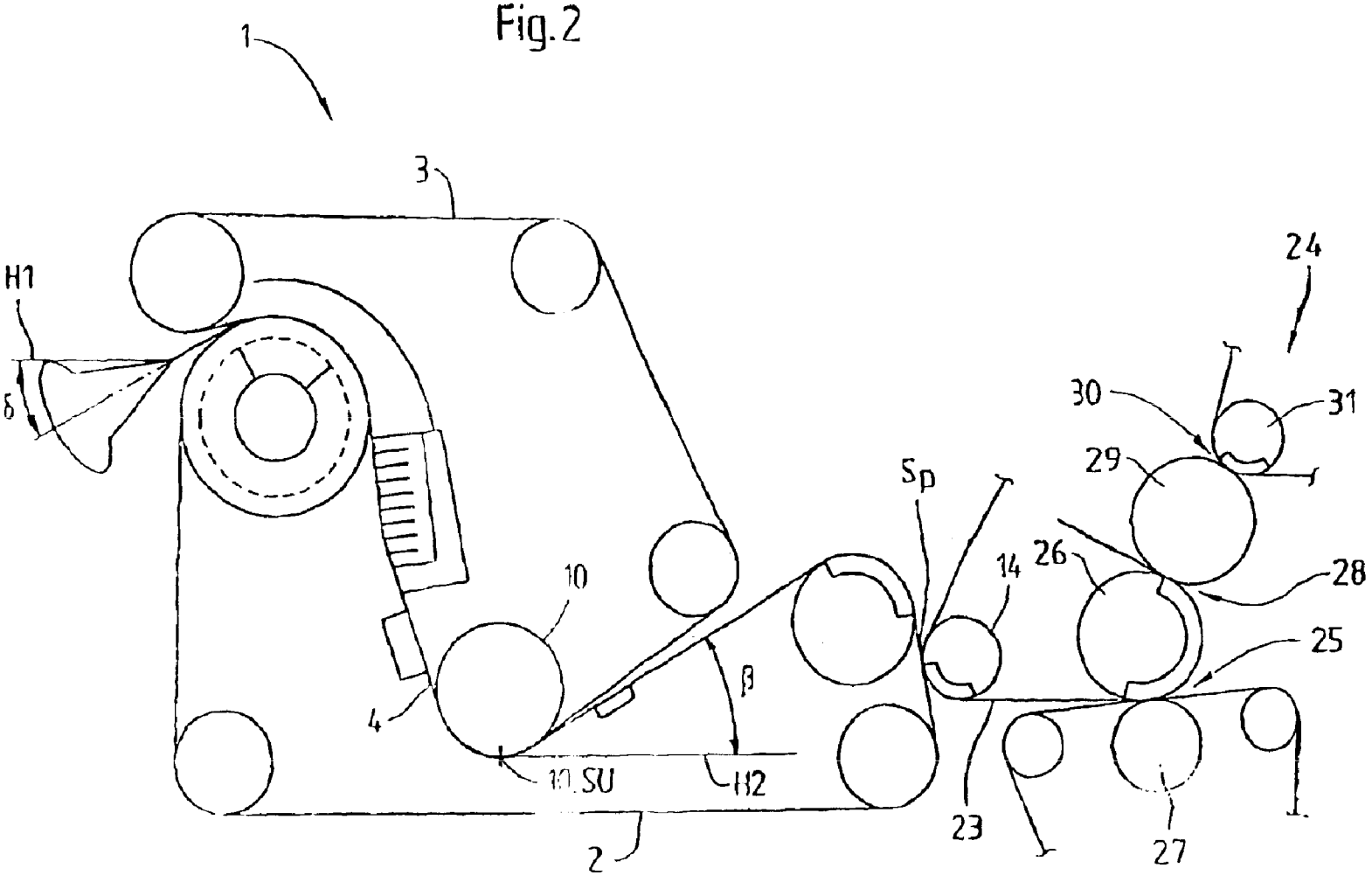
FIG. 2 shows a schematic and section side view of a second advantageous embodiment of the twin-wire former according to the invention.

The twin-wire former 1 illustrated in schematic and section side view in FIG. 2 in principle resembles the twin-wire former of FIG. 1; with regard to the further description of the twin-wire former 1, reference is made to the description of FIG. 1.

According to the invention, in the second advantageous embodiment of the twin-wire former 1 according to the invention, provision is now made for the two wire belts 2, 3, after the first deflection device 10, to run upward at an angle β relative to an imaginary second horizontal plane H2, for a felt 23 to remove the forming fibrous web 4 from the wire belt 2 at a pickup point $S_p$, which is located above the lower vertex 10.SU of the first deflection device 10, and for the pickup point $S_p$ to be followed by a press unit 24, in which the forming fibrous web 4 is guided first through a first, preferably double-felted press nip 25 with a first press roll 26 and a second press roll 27, after the first press nip 25 is guided, with one of the felts 23, around the first press roll 26, is then transferred to a non-felted press roll 29 in a second press nip 28, and then runs through at least one further single-sidefelted press nip 30, which is formed by the non-felted press roll 29 and a suction-roll 31.

Furthermore, the invention further provides for the pickup point $S_p$ to be located at least 50 mm, preferably at least 100 mm, in particular at least 200 mm, above the lower vertex 10.SU of the first deflection device 10.

The press unit 24 illustrated in FIG. 2 is taken as an extract from the German Published Specification DE 196 54 325 A1 (PC10453 DE). In addition, the German Published Specification DE 197 44 341 A1 (PC10623 DE) discloses further-reaching embodiments of an appropriate press unit. The descriptions of these two aforementioned published specifications are hereby in full made the subject of the present description.

The press unit 24 in a further embodiment can further be followed by at least one further press unit which is not illustrated but is included in the prior art, the combination of individual press units also being possible. The design of the press unit 24 is therefore not restricted to the design of the same illustrated and described.

The angle δ runs downward in the counterclockwise direction in relation to the imaginary first horizontal plane. H1 in FIG. 2.

Figure 3:
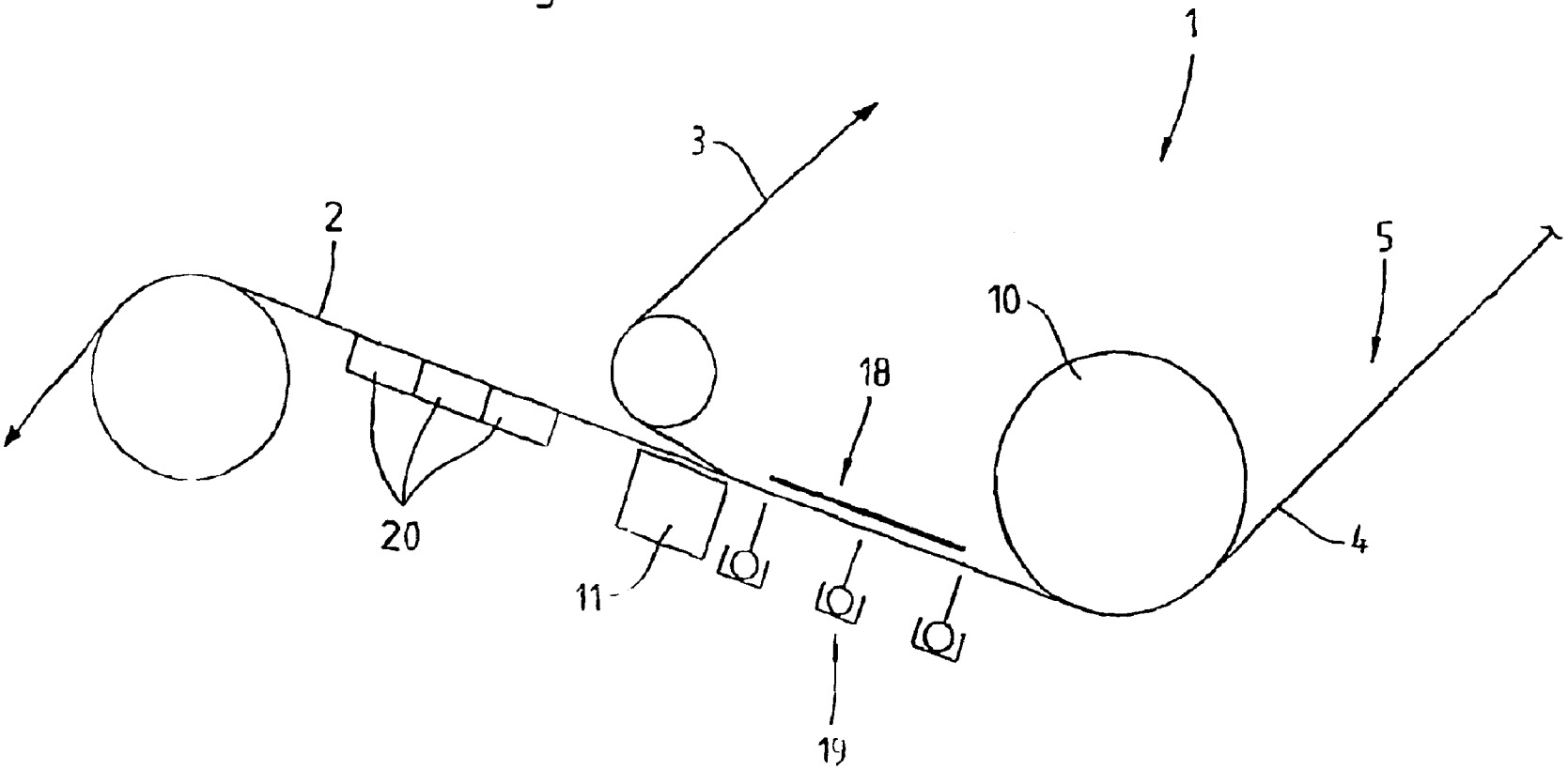
FIGS. 3 to 6 show schematic and section side views of further advantageous embodiments of the twin-wire former according to the invention.

A further advantageous, embodiment of the twin-wire former 1 according to the invention is illustrated in schematic and section side view in FIG. 3. This twin-wire former 1 possesses substantially the same construction with regard to the twin-wire zone 5 as the twin-wire former of FIG. 1.

According to the invention, however; isobaric dewatering elements 18, 19, as they are known, are arranged between the first deflection device 10 and the separating device 11 of this twin-wire former 1, between which the forming fibrous web 4 runs, enclosed between the two wire belts 2, 3. Isobaric dewatering elements 18 of this type are described in the German Published Specification DE 197 33 316 A1 (PB10569 DE)of the Applicant; the content of this aforementioned published specification is hereby made the subject of this description. Arranged on the upper wire 3 is a stationary isobaric dewatering element 18, and at least one isobaric dewatering element 19 is arranged on the lower wire 2 and can be set resiliently against the lower wire 2 by way of a selectable force. It goes without saying that the isobaric dewatering elements 18, 19 can also act on the wire belts 2, 3 in the converse arrangement. The isobaric dewatering elements 18, 19 are designed as plates or plate segments.

Furthermore, three flat suction elements 20 are arranged after the separating device 11 and act on the lower wire 2, which carries the forming fibrous web 4.

Figure 4:
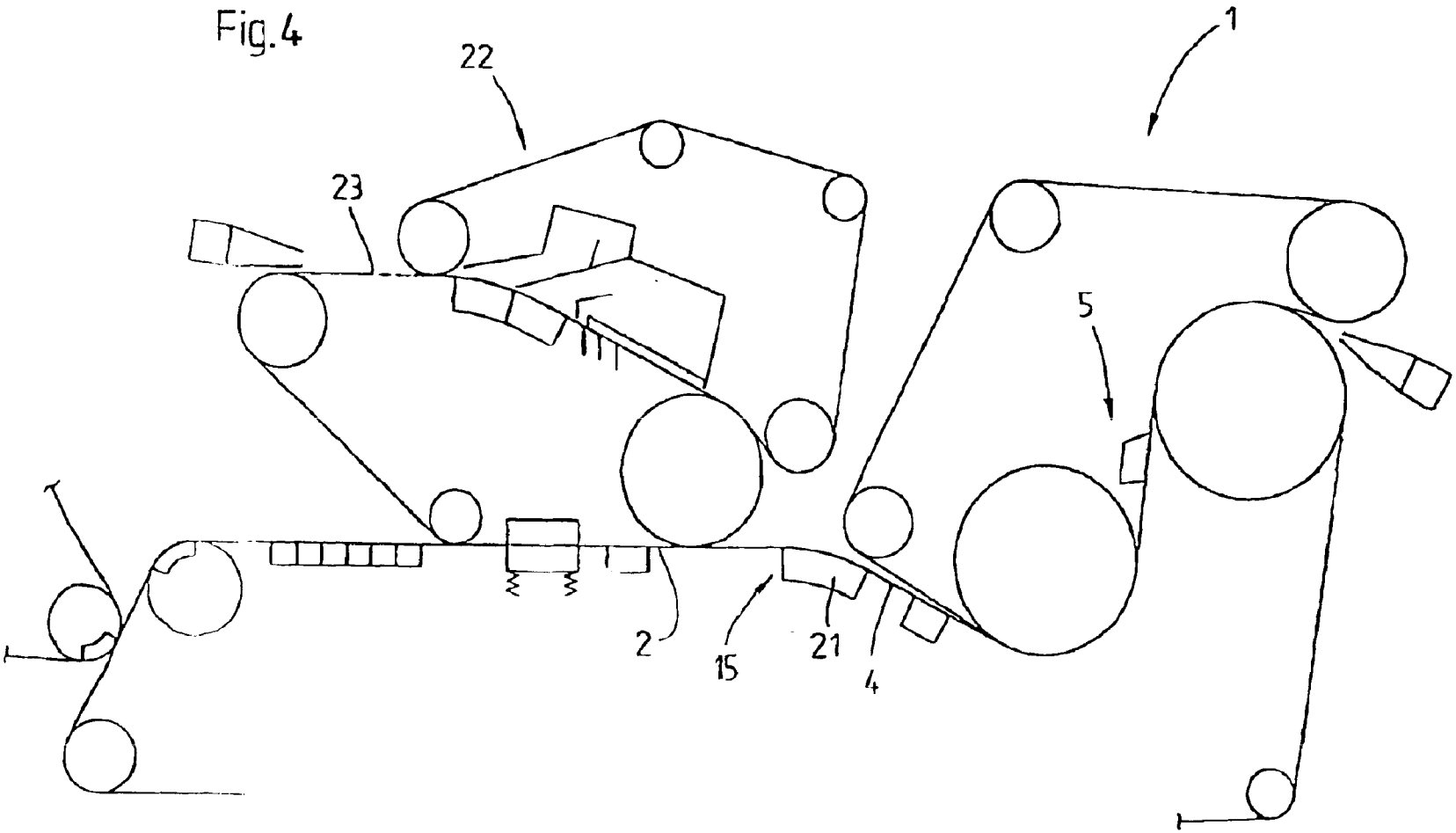

A further advantageous embodiment of the twin-wire former 1 according to the invention is illustrated in schematic and section side view in FIG. 4. This twin-wire former 1 has substantially the same construction with regard to the twin-wire zone 5 as the twin-wire former of FIG. 1.

According to the invention, the second deflection device 15 is designed as a shoe 21. The deflection is carried out in such a way that the lower wire 2 subsequently runs substantially horizontally. Arranged after the second deflection device 15 is a further sheet forming device 22, which produces a further fibrous web 4.1. The two fibrous webs 4, 4.1 are couched by way of known devices and transported to further manufacturing stages in the paper, board or tissue machine. Since the further sheet forming device is designed as a former belonging to the known prior art, preferably a hybrid former, it will not be discussed specifically; instead, reference is made to the known prior art.

Figure 5:
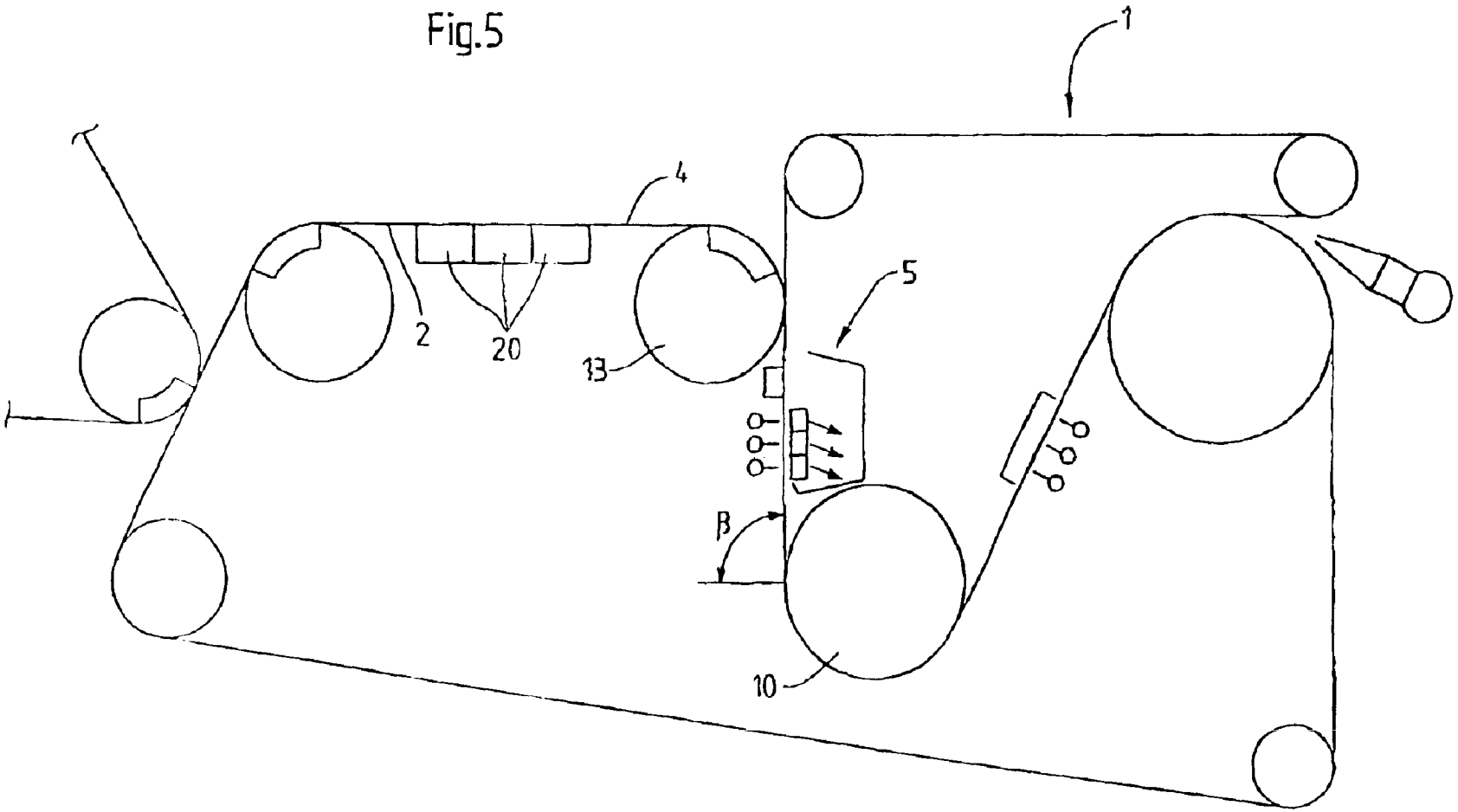

A further advantageous embodiment of the twin-wire former 1 according to the invention is shown in schematic and section side view in FIG. 5.

As distinct from the other figures, according to the invention, the angle β assumes a value of 90°, so that the twin-wire zone 5 runs vertically upward after the first deflection device 10. This results in the advantage of improved removal of water without rewetting and without the use of vacuum. After the separation of the wires, the lower wire 2, together with the forming fibrous web 4, is guided over a suction roll 13 into a horizontal position. The lower wire 2 together with the forming fibrous web 4 then runs over three flat suction elements 20, which act on the lower wire 2, which carries the forming fibrous web 4.

Figure 6:
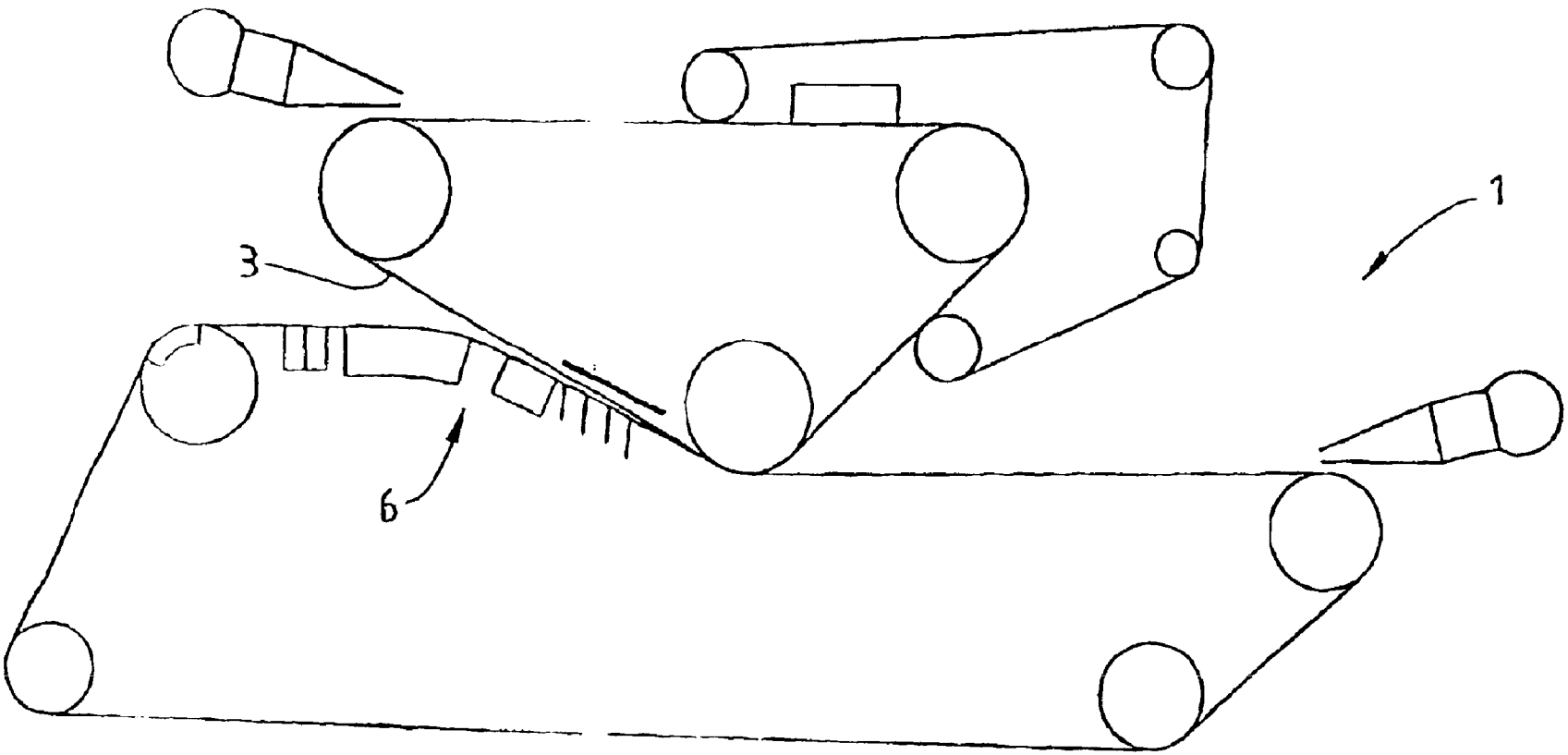

The twin-wire former 1 illustrated in schematic and section side view in FIG. 6 is designed as a hybrid former, known per se, the upper wire 3 of the hybrid former simultaneously forming the fourdrinier wire of a top-fitted fourdrinier wire former with a top fitted hybrid former. With regard to the S-shaped web guidance and the fitting of dewatering elements 6, in particular of isobaric dewatering elements, reference is made to the above embodiments.

In summary, it is to be recorded that the invention provides a twin-wire former of the type mentioned at the beginning of which the overall height is reduced in such a way that, in the case of rebuilds, no significant additional costs (rebuilding costs, overhaul costs, operating costs) arise, and which permit complete secondary dewatering at relatively high machine speeds.

LIST OF REFERENCE SYMBOLS

1 Twin-wire former
2 Lower wire (wire belt)
3 Upper wire (wire belt)
4, 4.1 Fibrous web
5 Twin-wire zone
6 Dewatering element
7 Forming roll
8 Inlet gap
9 Headbox
10 First deflection device
11 Separating device
12 Guide roll
13 Suction roll
14 Pickup roll
15 Second deflection device
16 Roll
17 Suction separator
18, 19 Isobaric dewatering element
20 Flat suction element
21 Shoe
22 Sheet forming device
23 Felt
$S_p$ Pickup point
24 Press unit
25 Press nip (preferably double-felted)
26 First press roll
27 Second press roll
28 Second press nip
29 Press roll (nonfelted)
30 Press nip (felted on one side)
31 Suction roll
A Distance
D7,D13,D15 Roll diameter
H Overall height
H1 First horizontal plane
H2 Second horizontal plane
10.SU Lower vertex
15.S0 Upper vertex
V1 First vertical plane
V2 Second vertical plane
α,β,γ,δAngle

What is claimed is:

1. A twin-wire former for producing a fibrous web, such as a paper, board or tissue web, from a fibrous stock suspension, said twin-wire former comprising:

two endless wire belts arranged to form a twin-wire zone;

a dewatering element;

a headbox positioned at an angle relative to an imaginary first horizontal plane;

said twin-wire zone comprising a first section in which said two wire belts are arranged to run over said dewatering element, and said two wire belts further being positioned to form a wedge-like inlet gap that is structured and arranged to receive a fibrous stock suspension directly from said headbox;

additional dewatering elements;

said twin-wire zone comprising a second section in which said two wire belts along with the fibrous web forming between said two wire belts are arranged to run downward over said additional dewatering elements at an angle of 10° to 60° relative to an imaginary first vertical plane;

a first deflection device having a lower vertex;

at least one separating device that acts over a machine width;

at an end of said second section, said two wire belts are arranged to run over said lower vertex of said first deflection device and then over said at least one separating device;

in a region of said at least one separating device, one of said two wires belts arranged to be led away from the forming fibrous web and the other of said two wire belts;

a second deflection device having an upper vertex being positioned after said at least one separating device and structured and arranged to deflect said other wire belt that carries the forming fibrous web;

after said first deflection device, said two wire belts are arranged to run upward at an angle relative to an imaginary second horizontal plane such that said upper vertex of said second deflection device is located above said lower vertex of said first deflection device;

a felt positioned at a pickup point located above said lower vertex of said first deflection that is structured and arranged to remove the forming fibrous web from said other wire belt a press unit positioned after said pickup point, said press unit comprising a first nip formed by a first press roll and a second press roll, such that the forming fibrous web is guided through said first press nip; and after the first press nip, said press unit is further structured to guide the forming fibrous web around said first press roll and then to transfer the forming fibrous web to a non-felted press roll in a second press nip and then through at least one further single-side-felted press nip.

2. The twin-wire former in accordance with claim 1, wherein said first press nip is a double felted press nip, and said felt is arranged to guide the forming fibrous web over said first press roll.

3. The twin-wire former in accordance with claim 1, wherein said pickup point is located at least 50 mm above said lower vertex of said the first deflection device.

4. The twin-wire former in accordance with claim 3, wherein said pickup point is located at least 100 mm above said lower vertex.

5. The twin-wire former in accordance with claim 4, wherein said pickup point is located at least 200 mm above said lower vertex.

6. A twin-wire former for producing a fibrous web, such as a paper, board or tissue web, from a fibrous stock suspension, said twin-wire former comprising:

two endless wire belts arranged to form a twin-wire zone;

a dewatering element;

a headbox positioned at an angle relative to an imaginary first horizontal plane;

said twin-wire zone comprising a first section in which said two wire belts are arranged to run over said dewatering element, and said two wire belts further being positioned to form a wedge-like inlet gap that is structured and arranged to receive a fibrous stock suspension directly from said headbox;

additional dewatering elements;

said twin-wire zone comprising a second section in which said two wire belts along with the fibrous web forming between said two wire belts are arranged to run downward over said additional dewatering elements at an angle of 10° to 60° relative to an imaginary first vertical plane;

a first deflection device having a lower vertex;

at least one separating device that acts over a machine width;

at an end of said second section, said two wire belts are arranged to run over said lower vertex of said first deflection device and then over said at least one separating device;

in a region of said at least one separating device, one of said two wires belts arranged to be led away from the forming fibrous web and the other of said two wire belts;

a second deflection device having an upper vertex being positioned after said at least one separating device and structured and arranged to deflect said other wire belt that carries the forming fibrous web; and after said first deflection device, said two wire belts are arranged to run upward at an angle relative to an imaginary second horizontal plane such that said upper vertex of said second deflection device is located above said lower vertex of said first deflection device, wherein, at said second deflection device, said other wire belt is arranged to be substantially horizontally guided.

7. The twin-wire former in accordance with claim 6, wherein said other wire belt is arranged to run over said lower vertex of said first deflection device.

8. The twin-wire former in accordance with claim 6, wherein said other wire belt is arranged to run at least 50 mm above said lower vertex of said first deflection device.

9. The twin-wire former in accordance with claim 8, wherein said other wire belt is arranged to run at least 100 mm above said lower vertex.

10. A twin-wire former for producing a fibrous web such as a paper board or tissue web, from a fibrous stock suspension, said twin-wire former comprising:

two endless wire belts arranged to form a twin-wire zone;

a dewatering element;

a headbox positioned at an angle relative to an imaginary first horizontal plane;

said twin-wire zone comprising a first section in which said two wire belts are arranged to run over said dewatering element, and said two wire belts further being positioned to form a wedge-like inlet gap that is structured and arranged to receive a fibrous stock suspension directly from said headbox;

additional dewatering elements;

said twin-wire zone comprising a second section in which said two wire belts along with the fibrous web forming between said two wire belts are arranged to run downward over said additional dewatering elements at an angle of 10° to 60° relative to an imaginary first vertical plane;

a first deflection device having a lower vertex;

at least one separating device that acts over a machine width;

at an end of said second section, said two wire belts are arranged to run over said lower vertex of said first deflection device and then over said at least one separating device;

in a region of said at least one separating device, one of said two wires belts arranged to be led away from the forming fibrous web and the other of said two wire belts;

a second deflection device having an upper vertex being positioned after said at least one separating device and structured and arranged to deflect said other wire belt that carries the forming fibrous web;

after said first deflection device said two wire belts are arranged to run upward at an angle relative to an imaginary second horizontal plane such that said upper vertex of said second deflection device is located above said lower vertex of said first deflection device; and a further sheet forming device arranged after said second deflection device.

11. The twin-wire former in accordance with claim 10, wherein said further sheet forming device comprises a hybrid former.

12. A twin-wire former for producing a fibrous web, such as a paper, board or tissue web, from a fibrous stock suspension, said twin-wire former comprising:

two endless wire belts arranged to form a twin-wire zone;

a dewatering element;

a headbox positioned at an angle relative to an imaginary first horizontal plane;

said twin-wire zone comprising a first section in which said two wire belts are arranged to run over said dewatering element, and said two wire belts further being positioned to form a wedge-like inlet gap that is structured and arranged to receive a fibrous stock suspension directly from said headbox;

additional dewatering elements;

said twin-wire zone comprising a second section in which said two wire belts along with the fibrous web forming between said two wire belts are arranged to run downward over said additional dewatering elements at an angle of 10° to 60° relative to an imaginary first vertical plane;

a first deflection device having a lower vertex;

at least one separating device that acts over a machine width;

at an end of said second section, said two wire belts are arranged to run over said lower vertex of said first deflection device and then over said at least one separating device;

in a region of said at least one separating device, one of said two wires belts arranged to be led away from the forming fibrous web and the other of said two wire belts;

a second deflection device having an upper vertex being positioned after said at least one separating device and structured and arranged to deflect said other wire belt that carries the forming fibrous web; and after said first deflection device, said two wire belts are arranged to run upward at an angle relative to an imaginary second horizontal plane such that said upper vertex of said second deflection device is located above said lower vertex of said first deflection device, wherein said dewatering device comprises forming roll having a diameter greater than 1200 mm, wherein said forming roll comprises an open forming roll, and wherein a roll diameter of said first deflection device is greater than at least one of a roll diameter of said forming roll and of a roll diameter of said second deflection device.

13. A process of dewatering a web in an apparatus that includes two endless wire belts arranged to form a twin-wire zone having at least a first and second section, a first dewatering element located in the first section and the two endless wire belts being arranged to form a wedge-like inlet gap, a headbox arranged at an angle to a horizontal reference in a vicinity of the inlet gap, a second dewatering element located in the second section, a first deflection device, located at an end of the second section, having a lower vertex, at least one separating device structured and arranged to act over an entire machine width, and a second deflection device located after the at least one separating device relative to a belt travel direction, said process comprising:

supplying a fibrous stock suspension into the inlet gap, whereby a forming fibrous web is located between the two endless wire belts;

guiding the forming fibrous web and the two endless wire belts over at least a portion of the first dewatering element;

guiding the forming fibrous web and the two endless wire belts obliquely downward, relative to a vertical reference, over the second dewatering element;

guiding the forming fibrous web and the two endless wire belts over the lower vertex of the first deflection device;

after the first deflection device guiding the two endless wire belts to run upward at an angle to the horizontal reference such that the lower vertex of the first deflection device is located below an upper vertex of the second deflection device;

separating a first of the two endless wire belts from a second of the two endless wire belts carrying the forming fibrous web in a region of the at least one separating device; and guiding the second endless wire belt carrying the forming fibrous web over the second deflection device, wherein the apparatus further includes a felt and a press unit, and said process further comprises:

removing the forming fibrous web from the second endless wire belt with the felt at a pickup point located above the lower vertex; and pressing the forming fibrous web in the press unit, arranged to follow the pickup point, relative to a belt travel direction, which includes a first and second press roll arranged to form a first press nip and third press roll arranged to form a second press nip, and a fourth press roll arranged to form a single side felted third press nip.

* * * * *